US006526695B1

(12) United States Patent
Nguyen

(10) Patent No.: US 6,526,695 B1
(45) Date of Patent: Mar. 4, 2003

(54) BREAKOUT CAPABLE SLIDING DOOR ASSEMBLY WITH PIVOT CONNECTION FOR TRANSMITTING LOAD TO TOP RAIL

(75) Inventor: Quan H. Nguyen, Hartford, CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/615,773

(22) Filed: Jul. 13, 2000

Related U.S. Application Data

(60) Provisional application No. 60/143,527, filed on Jul. 13, 1999, and provisional application No. 60/160,201, filed on Oct. 19, 1999.

(51) Int. Cl.[7] ..... E05B 65/10
(52) U.S. Cl. ..... 49/141; 49/258; 49/260
(58) Field of Search ..... 49/141, 360, 260, 49/258

(56) References Cited

U.S. PATENT DOCUMENTS

| | | | | |
|---|---|---|---|---|
| 84,868 A | | 12/1868 | Fenn | |
| 1,714,575 A | | 5/1929 | Stancliff | |
| 1,767,487 A | | 6/1930 | Shogren | |
| 2,086,529 A | | 7/1937 | Bontemps | |
| 2,206,755 A | | 7/1940 | Schweller | |
| 2,208,802 A | * | 7/1940 | Montgomery | 49/251 |
| 2,603,825 A | | 7/1952 | Seaman | |
| 3,136,538 A | * | 6/1964 | Dimmitt et al. | 49/117 |
| 3,300,897 A | * | 1/1967 | Wikkerink | 49/137 |
| 3,318,047 A | * | 5/1967 | Carson | 49/149 |
| 3,354,581 A | * | 11/1967 | Dimmett et al. | 49/141 |
| 3,373,529 A | * | 3/1968 | Ingham | 49/381 |
| 3,378,954 A | | 4/1968 | Sandin | |
| 3,396,490 A | | 8/1968 | Dukas | |
| 3,464,159 A | * | 9/1969 | Hewitt et al. | 49/177 |
| 3,466,805 A | | 9/1969 | Muessel | |
| 3,491,483 A | * | 1/1970 | Miller | 49/141 |

(List continued on next page.)

FOREIGN PATENT DOCUMENTS

| | | |
|---|---|---|
| CA | 990585 | 6/1976 |
| DE | 3812881 | 11/1989 |
| DE | 19753132 | 6/1999 |
| GB | 972813 | 10/1964 |

*Primary Examiner*—Gregory J. Strimbu
(74) *Attorney, Agent, or Firm*—Pillsbury Winthrop LLP

(57) ABSTRACT

A sliding door assembly comprises a frame assembly, a sliding panel carrier, and a sliding panel mounted to the sliding panel carrier. The sliding panel carrier is mounted to the frame assembly for generally rectilinear movement to enable movement of the sliding panel between a closed position and an open position. The sliding panel carrier has a pivot pin receiving opening. A door controlling unit moves the sliding panel carrier in a generally rectilinear manner between the open and closed positions. The sliding panel has a mounting bracket mounted to the top rail thereof. The bracket includes a pivot pin that moves between extended and retracted positions. The sliding panel is mounted to the sliding panel carrier by inserting the pivot pin into the pivot pin receiving opening. As a result, the sliding panel can swing relative to the frame assembly through a breakout movement from a normal, non-breakout position to a breakout position. The bracket, the pivot pin, and the pivot pin receiving opening are constructed and arranged such that, when the sliding panel is moved in a swinging manner to the breakout position thereof, a load applied to the sliding panel that tends to pivot the sliding panel about a point spaced from the pivot pin creates a reaction force that is applied to the pivot pin and is transmitted to the sliding panel top rail through the bracket.

6 Claims, 10 Drawing Sheets

U.S. PATENT DOCUMENTS 3,507,074 A 4/1970 Gallegos
3,778,932 A 12/1973 Ewing
3,792,644 A 2/1974 Ferguson et al.
3,834,081 A * 9/1974 Catlett ..... 49/360
3,863,391 A 2/1975 Horvay et al.
4,305,227 A * 12/1981 Georgelin ..... 49/141
4,377,055 A 3/1983 Frederick
4,445,589 A 5/1984 Longenecker
4,620,392 A 11/1986 Kerpers et al.
4,785,579 A 11/1988 Sugiyama et al.
5,040,268 A 8/1991 Knurr
5,165,770 A 11/1992 Hahn
5,369,912 A 12/1994 Ginzel et al.
5,417,011 A * 5/1995 Keszthelyi ..... 49/334
5,483,770 A 1/1996 Marinoni
5,486,026 A 1/1996 Borgardt
5,490,305 A 2/1996 Domingo Ribot
5,553,352 A 9/1996 Bolton
5,581,944 A * 12/1996 Kornbrekke et al. ..... 49/28
5,634,297 A * 6/1997 Ito ..... 49/360
6,170,195 B1 * 1/2001 Lim ..... 49/196

* cited by examiner

BREAKOUT CAPABLE SLIDING DOOR ASSEMBLY WITH PIVOT CONNECTION FOR TRANSMITTING LOAD TO TOP RAIL

The present application claims priority to both U.S. Provisional Application of Collello et al., Ser. No. 60/143,527, filed Jul. 13, 1999, and U.S. Provisional Application of Nguyen, Ser. No. 60/160,201, filed Oct. 19, 1999, the entirety of each of which are hereby incorporated into the present application by reference.

FIELD OF THE INVENTION

The present invention relates to automatic door assemblies. In particular, the present invention relates to a sliding door assembly having a damping device that provides controlled resistance to swinging movement of a panel during breakout.

BACKGROUND OF THE INVENTION

Sliding door assemblies known heretofore conventionally have a frame assembly with a pair of non-sliding panels mounted thereto and one or two sliding door panels that move in a generally rectilinear manner between opened and closed positions. The non-sliding panels are positioned such that they are on opposing lateral sides of the sliding panels when the sliding door panels are closed. During normal operation, a power-operated overhead door operator moves the sliding panel(s) between the opened and closed positions thereof.

Oftentimes, either the sliding panels, the non-sliding door panels, or both are provided with the capability to open outwardly in a swinging manner under an application of manual force to allow persons to pass through the door assembly during emergency conditions wherein the door operator is unable to open the sliding panel(s). This capability, referred to in the art as "breakout," is usually required by state or local building codes as a safety measure for allowing exit from buildings during fires, power outages, and other such emergency situations wherein the door operator may be unable to function properly.

It has been known in the field of automatic door assemblies to provide the panels with breakout capability with a yieldable detent device for maintaining a breakout panel in its normal, non-breakout condition until a predetermined amount of force is applied to the panel. The amount of force required to move the panel in a breakout manner usually has a maximum set by local codes. However, once the panel has been moved out of its normal, non-breakout condition, these yieldable devices do not function to control the manner in which the panel continues to open.

To control the manner in which the breakout panel swings once breakout has begun and the panel is released from the above-described yieldable detent device, damping devices have been connected at one end to the top rail of the breakout panel and at the other end to the header that houses the door controlling unit. These devices are designed to provide controlled resistance to the swinging breakout movement of the panel. Specifically, these devices prevent the panel from being thrown open in an uncontrolled manner by persons seeking exit through the door assembly and also prevent high winds from acting on the panel and also throwing it open in a uncontrolled manner.

One example of a known damping device comprises a U-shaped track structure that defines a U-shaped channel and a rod with a plastic block on one end thereof. The track structure fixedly connects to the top rail of the door panel in the longitudinal direction thereof, the rod pivotally connects to the header of the door frame, and the rod and track structure are assembled together with the plastic block fit tightly in the U-shaped channel. As the panel is swung open during breakout, the plastic block slides within the U-shaped channel so that the friction between the block and the channel walls provides a controlled resistance to the panel's movement.

One problem with the use of these extendible and retractable devices can be appreciated from viewing FIG. 1. FIG. 1 is a schematic overhead view of a conventional door assembly 100 with a header 102, a breakout panel 104 opened 90° from normal, and a damping device 106 for controlling the swinging movement of the panel 104, such as the U-shaped channel and block arrangement mentioned above. The device 106 has a metal track 103 with interior surfaces and a plastic friction block 105 tightly received in the track 103. The block 105 is mounted on a metal rod 107 and a spring 109 is disposed between the block 105 and the end of the track to resist the door panel's opening movements. The panel 104 is pivotally connected to the header 102 by pivot pin 108. When a load is applied to the panel 104, as indicated at $F_L$, the pivotal connection between the rod 107 and the block 105 of the damping device 106 acts as fulcrum point. Also, the pivot pin 108 provides a fulcrum point. Accordingly, the application of load $F_L$ creates reaction forces at the pivotal connection between the rod 107 and the block 105 and on the pin 108. These reaction forces are illustrated by the arrows shown in FIG. 1.

It is to be understood that the reaction forces on the pivot pin may be created by structures other than an extendible door swing controlling device. For example, a shopping cart may become wedged between the breakout panel and the building exterior as the panel is being opened. Also, the breakout panel may contact a portion of the frame assembly as it approaches opening 180 degrees, thereby providing the panel with a leverage point. Thus, it could be broadly stated that these reaction forces are created as a result of a load that is applied to the breakout panel at a point distal the pivot pin which tends to pivot the breakout panel about a second point located intermediate the first point and the pivot pin.

Of particular concern in this arrangement are the reaction forces applied to the pivot pin 108. In conventional panels, the bracket that carries the pivot pin 108 is only attached to the interior of the vertical side rail or stile. Thus, the forces applied to the pivot pin 108 will be transferred to and be borne by the stile. The problem with this is that most side stiles are thin-walled metal extrusions and may become deformed under the forces applied to the pivot pin 108. Specifically, brackets that have been previously mounted inside side stiles are mounted by fasteners to only one side wall thereof with spacing provided between the bracket and the other side walls. As a result, when a force is applied to the bracket, this force is localized on the fasteners that mount the bracket. In addition, the spacing provided between the other side walls of the stile and the bracket allows the bracket to move under this force, thereby inwardly deforming the side wall to which it is mounted, particularly at the points where the fasteners are located. Permanent deformation of the side stile may result if the loads and reaction forces involved are high enough. One possible solution would be to use a stile with thicker walls. However, the costs of metal extrusions increase significantly as the wall thickness increases and likewise the overall weight of the panel increases.

In the above-described arrangement with the bracket mounted to one wall of the stile, the pin is normally extendible and retractable and a spring is mounted inside the bracket to bias the pin to its extended position. The advantage of this arrangement is that it makes the door panel relatively easy to install. Specifically, the installer retracts the pin, positions the door panel in place with the pin in alignment with its corresponding aperture on the door carrier or header, and then releases the pin for its spring-biased movement into the corresponding aperture.

Another prior art construction alleviates the stile deformation problem mentioned above with respect to the arrangement with the bracket mounted to a side wall of the stile. This second prior art construction is shown in FIG. 2. This construction, generally indicated at 200, comprises an upper bracket 202 that mounts to the sliding door panel carrier and a lower bracket 204 that mounts to the top rail of the door panel. The pivot pin 206 is fixed to the lower bracket 204 and pivotally mounted to the upper bracket by a ball bearing assembly 207 so that the upper and lower brackets 202, 204 pivot relative to one another. When the door panel is assembled, the reaction forces discussed above are distributed to the top rail of the door panel in the longitudinal direction thereof. As a result, the problems associated with the deformation of the stile wall are obviated because all the reaction forces are transmitted to the top rail. Because these reaction forces are being transmitted to the top rail in its longitudinal direction, the top rail is capable of withstanding relatively high reaction forces without deformation.

The problem with this arrangement is that it is relatively difficult to install in comparison with the previously described arrangement with the bracket mounted to the stile interior. To install the construction shown in FIG. 2, the upper bracket 202 must first be mounted to the door panel carrier while the lower bracket 204 is disconnected from the door panel. Then, the lower bracket 204 must be pivoted out to about ninety degrees relative to the upper bracket 202 and then connected to the door panel's top rail by a plurality of fasteners. This installation procedure is relatively difficult and inefficient compared to the retractable pivot pin arrangement described above.

Thus, it can be appreciated from the foregoing that each of the above-described described prior art constructions has certain advantages and disadvantages concerning load distribution and installation. It would be desirable to provide a device that provides the advantages of both of the above-discussed prior art constructions while eliminating their disadvantages. To date, it is believed that no such device has been provided and thus, there exists a need in the art for such a device.

SUMMARY OF THE INVENTION

It is therefore an objective of the present invention to meet the above-described need. To meet this objective, the present invention provides a sliding door assembly that comprises a frame assembly, a sliding panel carrier, and a sliding panel mounted to the sliding panel carrier. The sliding panel carrier is mounted to the frame assembly for generally rectilinear movement to enable movement of the sliding panel between a closed position and an open position. The sliding panel carrier provides a pivot pin receiving opening. A power-operated door controlling unit is operatively connected to the sliding panel carrier and moves the same in a generally rectilinear manner between the open and closed positions.

The sliding panel has a mounting bracket mounted to the top rail thereof. The bracket provides a pivot pin that moves between an extended and retracted positions. The sliding panel is mounted to the sliding panel carrier by inserting the pivot pin into the pivot pin receiving opening. As a result, the sliding panel can swing relative to the frame assembly though a breakout movement under an application of manual force from (1) a normal, non-breakout position to (2) a breakout position. The term "bracket" is intended to generically encompass any structure suitable for mounting the pivot pin to the top rail of the panel. The bracket, the pivot pin, and the pivot pin receiving opening are constructed and arranged such that, when the door assembly is installed and the sliding panel is moved in a swinging manner to the breakout position thereof, a load applied to the sliding panel that tends to pivot the sliding panel about a point spaced radially the pivot pin creates a reaction force that is applied to the pivot pin which reaction force is transmitted to the top rail of the sliding panel as a result of the mounting bracket being mounted thereon and the pivot pin being received in the pivot pin receiving opening.

As a result of this construction, the problems associated with reaction forces causing side stile deformation are obviated because such forces are transferred to and absorbed by the top rail. Specifically, the top rail is better suited to handle these reaction forces because it is oriented in the same general plane in which the reaction forces are normally created, whereas the side stile is oriented generally perpendicular to such a plane and, as a result, transferal of reaction forces causes inward deformation of the stile walls. Further, the installation of the sliding panel can be easily and effectively performed using the extendible and retractable pivot pin arrangement. Thus, the door assembly of the present invention achieves the advantages of the prior art arrangements without the associated disadvantages.

The bracket arrangement of the present invention may also be applied to non-sliding panels. In fact, the present invention contemplates applying the principles of the present invention to any type of panel in any type of sliding door assembly that is capable of breakout movement.

Other objects, features, and advantages of the present invention will become apparent from the following detailed description, the accompanying drawings, and the appended claims.

DETAILED DESCRIPTION OF THE PREFERRED EMBODIMENT OF THE INVENTION

Figure 3:
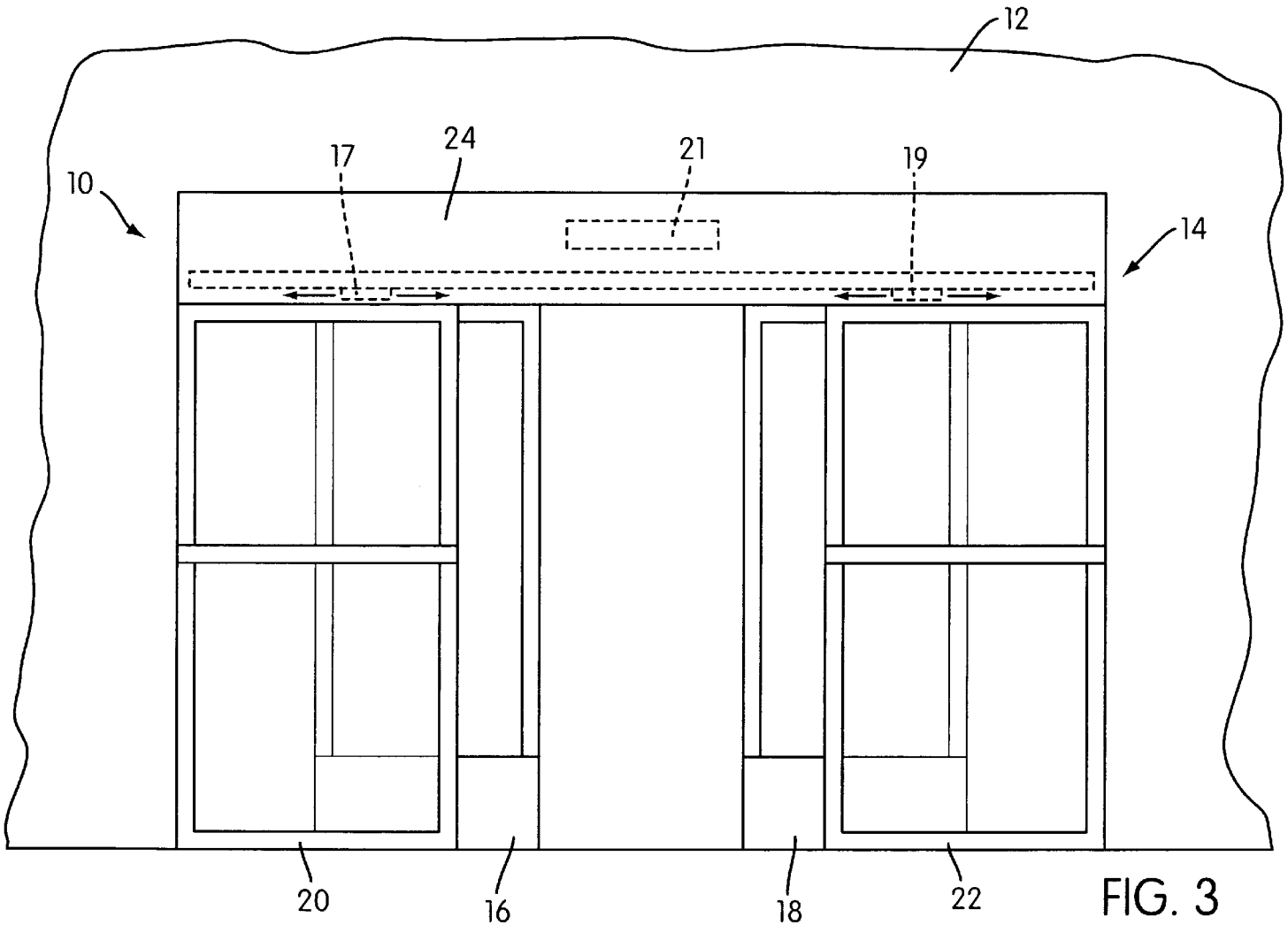
FIG. 3 shows a front view of a sliding door assembly mounted across the opening of a building wall.

FIG. 3 shows a sliding door assembly, generally indicated at 10, installed across an opening formed through the wall 12 of a building. The door assembly 10 comprises a frame assembly, generally indicated at 14, a pair of sliding panels 16, 18, and a pair of non-sliding panels 20, 22 that are disposed on opposing lateral sides of the sliding panels 16, 18. As is conventional in the art, the sliding panels 16, 18 are mounted on sliding panel carriers 17, 19. The door assembly 10 shown is intended to be exemplary and not limiting. For example, the principles of the present invention may be practiced on an assembly with a single sliding panel or an assembly without the non-sliding panels 20, 22. Examples of a door assembly with which the present invention may be practiced are the Duraglide 2000 or the Duraglide 3000, available from Stanley Access Technologies, located at 65 Scott Swamp Rd., Farmington, Conn. 06032.

One skilled in the art will appreciate that the frame assembly 14 may be of any construction and need not be explained herein in great detail. The exemplary frame assembly 14 has an overhead header 24 extending across the top edge thereof and upper and lower guide rails, tracks or the like for guiding the sliding panel carriers for rectilinear movement that enables movement of the sliding panels 16, 18 between their opened and closed positions. The sliding panel carriers may be sliding or rolling mounted in the tracks to facilitate such movement. Alternatively, the sliding panel carriers may be sliding or rolling mounted only on an upper track of the frame assembly, such as is shown in U.S. Pat. No. 3,491,483 to Miller, the entirety of which is incorporated into the present application by reference. The frame assembly 14 may also include generally vertically extending members, such as the one shown in FIG. 4 at 28, extending between the floor and the header 24.

The header 24 houses the components that move the sliding panels 16, 18 between the open and closed positions thereof. Any power-operated door controlling unit 21, such as the one disclosed in U.S. Pat. No. 3,834,081, the entirety of which is hereby incorporated into the present application by reference, may be operatively connected to the sliding panels 16, 18 to control the opening and closing movements of the sliding panels 16, 18. One skilled in the art will appreciate that such door operating units are well known in the art and need not be detailed herein.

Figure 4:
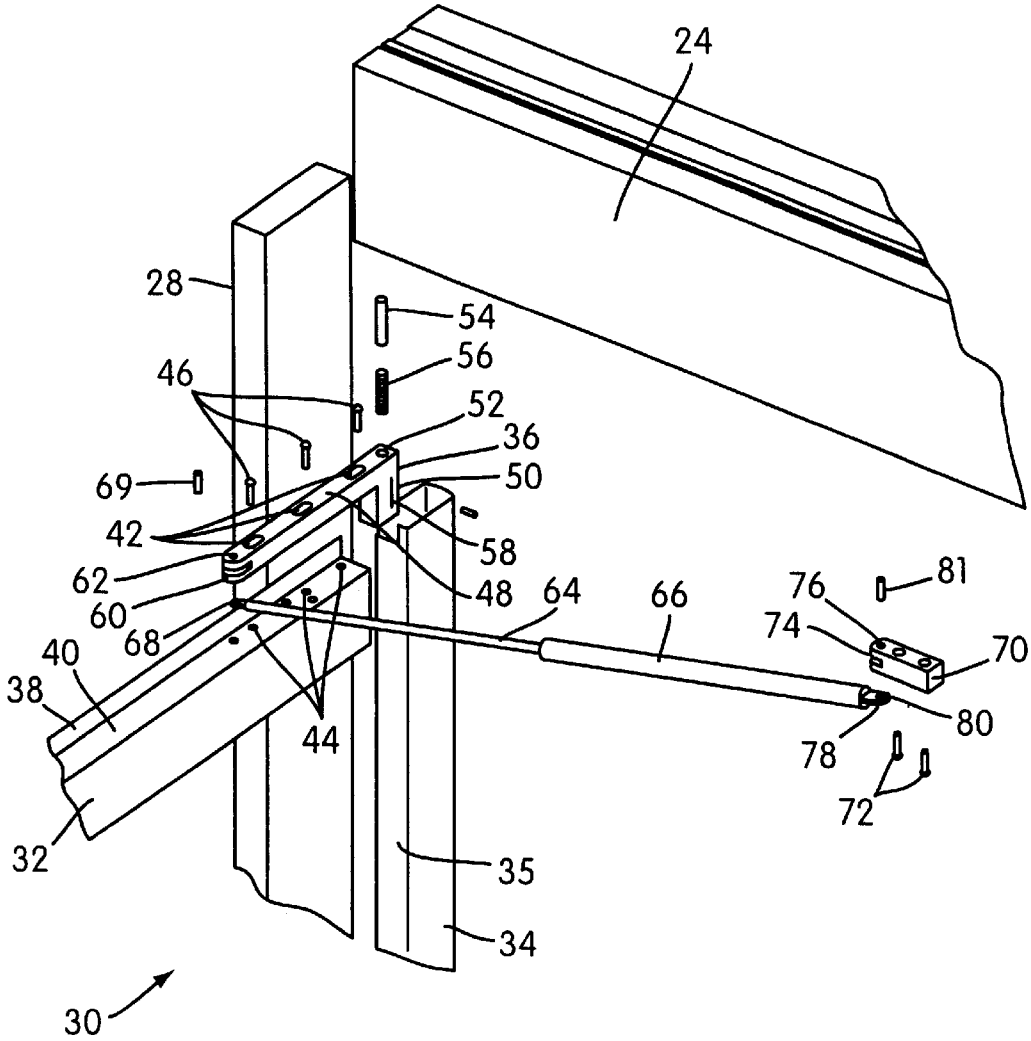
FIG. 4 shows an exploded perspective view of an upper corner of a breakout panel whereat the panel is pivotally connected to a header of the frame assembly, the breakout paneling either a sliding or a non-sliding panel.

FIG. 4 shows a breakout panel 30 that is to be opened in a swinging manner during emergency conditions wherein the door controlling unit is unable to function properly. The breakout panel 30 may be either a sliding panel 16, 18 or a non-sliding panel 20, 22. In arrangements wherein the non-sliding panels 20, 22 are omitted, such as pocket door assemblies or door assemblies wherein the sliding panels 14, 16 overlie the wall 12 when in their open positions, the breakout panel 30 could be one or both of the sliding panels 14, 16.

The breakout panel 30 comprises a top rail 32 and a side rail 34 (also known as a stile) which are formed separately and coupled together. A bottom rail (not shown) opposite the top rail 32 and a side rail (not shown) opposite side rail 34 are also provided to give the panel 30 an overall rectangular configuration. Preferably, the rails are each metal extrusions. A glass panel (not shown) or the like is received within the breakout panel 30 and held in place within grooves provided on the interior edges of the top, bottom, and side rails, such as the groove shown at 35 on side rail 34. Side rail 34 has a hollow construction and is connected to the top rail 32 by suitable means such as threaded fasteners or welding.

The top rail 32 has a generally rectangular cross-section and a flange 38 extending upwardly therefrom. An L-shaped bracket 36 and the upwardly facing surface 40 of the top rail 32 each have a plurality of fastener receiving openings 42, 44 that are arranged so that the bracket 36 can be engaged with the upwardly facing surface 40 of top rail 32 with the openings 42 of the bracket 36 aligning with the openings 44 of the top rail 32. A plurality of threaded fasteners 46 can then be inserted into the openings 42, 44 and tightened to fasten the bracket 36 to the top rail 32. As can be seen throughout the figures, the openings 42 on the bracket 36 are elongated in the brackets longitudinal direction. This ensures that the bracket 36 can be adjusted in the longitudinal direction of the top rail 32 when mounted to compensate for errors in the placement of the openings 44 of the top rail 32. This ensures that the pivot pin 54 will be properly positioned.

The bracket 36 is generally L-shaped with first and second legs 48 and 50, respectively, extending generally perpendicularly with respect to one another. The fastener receiving openings 42 are provided on the first leg 48 of the bracket 36. When the breakout panel 30 is assembled, the first leg 48 of the bracket 36 is fastened by fasteners 46 to the upper surface 40 of the top rail 32 with the side of the bracket 36 engaging the flange 38. The second leg 50 of the bracket 36 is received within the open end of the side rail 34. The bracket 36 does not function to attach the side rail 34 to the top rail 32. This attachment is done by fasteners, or welding, or another bracket. However, it is within the scope of the invention to use the bracket 36 to attach the side and top rails, although it is preferred to use other attachment means.

At the area where the first and second legs 48, 50 of the bracket 36 meet, a cylindrical opening 52 that extends into the interior of the second leg 50 is provided. A cylindrical pivot pin 54 and a spring 56 are mounted inside the second leg 50 through opening 52. The pin 54 moves between (1) an extended, operating position wherein the pivot pin 54 extends outwardly from the opening 54 and upwardly from the bracket 36, and (2) a retracted, inoperative position wherein the pivot pin 54 is retracted and withdrawn into the opening 52. The spring 56 is engaged with the pin 54 and a fixed spring bearing surface (not shown) inside the second leg 48 so that the spring 56 biases the pin 54 into the extended, operative position thereof. As will be described in further detail below, a releasable locking mechanism 58 is provided. The releasable locking mechanism 58 functions to maintain the pivot pin 54 in the retracted, inoperative position thereof until a manual manipulation occurs that releases the mechanism 58 so as to allow the spring 56 to move the pivot pin 54 to the extended, operative position thereof in a biased manner. A number of alternative arrangements for the releasable locking mechanism will be detailed later in the application.

A similar pivot pin may be provided at the adjacent lower corner of the breakout panel 30 by a bracket similar to bracket 36. The lower pivot pin may be extendible and retractable or fixed. In fact, both pivot pins may be extendible and retractable or the lower pin may be extendible and retractable with the upper pivot pin 54 being fixed. Alternatively, the lower adjacent carrier of the breakout panel 30 may have a pivot pin receiving opening that receives a pivot pin extending upwardly from a lower part of the frame assembly or the sliding panel carrier. This pivot pin receiving opening may be formed directly in the bottom rail or may be provided by a bracket similar to bracket 36.

A pivot pin receiving opening (not shown) is provided at upper and lower points of the frame assembly 14. Preferably, the lower pivot pin receiving opening is provided on a member (not shown) that extends along the floor, and the upper pivot pin receiving opening is provided on the header 24. When the breakout panel 30 is a non-sliding panel, the upper and lower pivot pin receiving openings are fixed. When the breakout panel 30 is a sliding panel, the upper and lower pivot pin receiving openings are formed in the sliding panel carriers.

To install the assembled breakout panel 30, the releasable locking mechanism 58 is manipulated so as to move the pivot pin 54 to the retracted, inoperative position and releasably lock it thereat. If the lower pivot pin is extendible and retractable, then the lower pivot pin should also be retracted to the inoperative position thereof and releaseably locked thereat. The breakout panel 30 can then be positioned in the frame assembly 14 so that the pivot pins are aligned with their respective pivot pin receiving openings. Next, the releasable locking mechanisms 58 associated with the upper and lower comers are manipulated so as to release the pivot pins 54 and allow the springs 56 to bias the pivot pins 54 to the extended, operative positions thereof. In the extended, operative positions thereof, the pivot pins 54 are received in the pivot pin receiving openings so as to enable pivoting opening and closing movements of the breakout panel 30 relative to the frame assembly 14.

The end of the first leg 48 of the bracket 36 opposite the second leg 50 has a pair of spaced apart tabs 60 that provide a pair of vertically aligned openings 62. The space between the tabs 60 is sufficient to receive the free end of a rod 64 that extends from an extendible and retractable gas or fluid-filled cylinder 66 therebetween. The free end of the rod 64 has an opening 68 therethrough that vertically aligns with openings 62. To pivotally secure the free end of the rod 64 to the bracket 36, a pivot pin 69 or the like is inserted through the vertically aligned openings 62, 68 on the tabs 60 and the free end of the rod 64.

The rod 64 is slidably received inside the cylinder 66. Preferably, the cylinder 66 is filled with a substantially incompressible hydraulic oil which is filled with a suitable fluid such as hydraulic oil, air, or the like. The cylinder 66 and rod 64 may be of any conventional type and need not be described in detail herein. Preferably, the cylinder 66 and rod 64 are of the type that has an internal flap valve arrangement (not shown) that provides greater resistance to an extending movement of the rod 64 than to a retracting movement of the rod 64. A bracket 70 is mounted on the underside of the header 24 (either directly or to the sliding panel carrier) by a pair of threaded fasteners 72. The bracket 70 has a pair of spaced apart tabs 74 that have vertically aligned openings 76 formed therethrough. The free end of the cylinder 66 has a projection 78 with an opening 80 formed therethrough. To pivotally connect the cylinder 66 to the frame assembly 14, the projection 78 is inserted between the tabs 74 so that the openings 76, 80 are vertically aligned and a pivot pin 81 or the like is inserted through the openings 76, 80.

During a breakout opening movement of the panel 30 under an application of manual force, the cylinder 66 acts as a damping device that provides controlled resistance to the panel's opening movement. As the panel 30 is opened in its breakout, swinging manner, the rod 64 is pulled outwardly and extended with respect to the cylinder 66. As a result, the cylinder 66 and rod 64 cooperate to yieldingly resist the panel's 30 movement. When the panel 30 is in its normal, non-breakout position, the rod 64 is withdrawn into the cylinder 66 and the rod 64 and cylinder 66 extend parallel and adjacent to the flange 38 on the top rail 32. In this position, flange 38 conceals the cylinder 66 and rod 64 from view from one side of the door assembly 10 to provide a more aesthetic appearance. Another flange (not shown) may be provided on the header 24 so that it extends parallel to flange 38 when the panel 30 is in its normal, non-breakout position. This additional flange would conceal the cylinder 66 and rod 64 from view from the opposing side of the door assembly 10 for aesthetic purposes.

It should be understood that the U-shaped channel and plastic block arrangement described above in the background section may be as a damping device used in place of a gas or fluid filled cylinder. However, the gas or fluid cylinder is preferred because it functions effectively over a broader force range. The preferred type of cylinder is one filled with hydraulic oil and having an internal flap valve arrangement that provides to resistance to its extension. One examples of a cylinder suitable for this purpose is a damping cylinder manufactured by and available from Suspa Inc., located at 3970 Roger Chamber Blvd., Grand Rapids, Mich. 49548-3497, as part number 16-4-394-335-A23-B23-DAMP. Another example of such a cylinder is manufactured by Stabilus, located at 1201 Tulip Drive, Gastonia, N.C. 28052, with a part number 4462LM. This Stabilus cylinder can be obtained from Oheheiser Corporation of 596 N. Mountain Rd., Newington, Conn. 06111.

Figure 1:
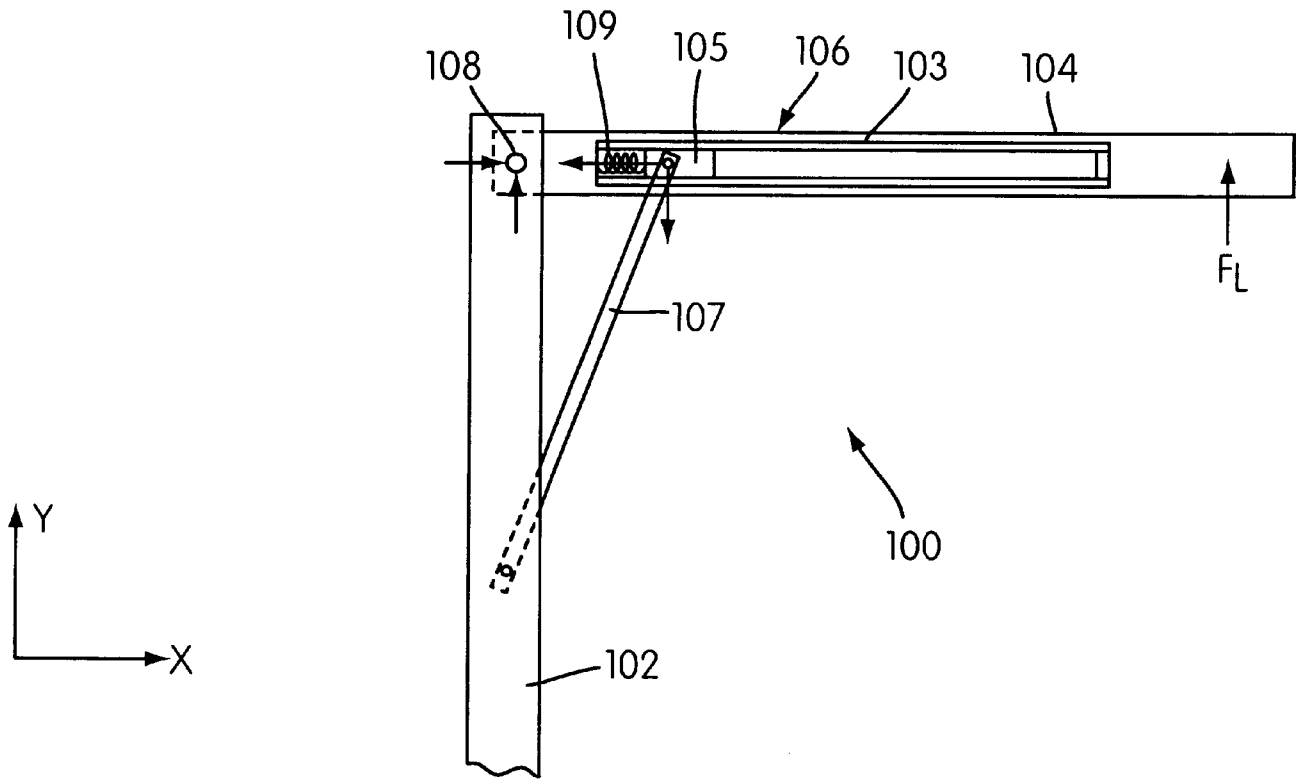
FIG. 1 PRIOR ART
FIG. 1 is an overhead schematic view of a door assembly illustrating the reaction forces created when a load ($F_L$) is applied to the breakout panel.
Figure 2:
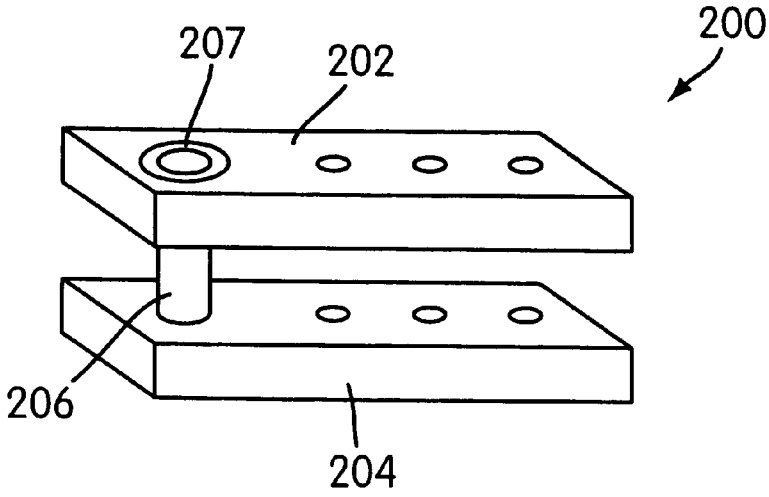
FIG. 2 shows a perspective view of a prior art bracket for mounting a sliding panel to a sliding panel carrier.

The use of bracket 36 is advantageous because it ensures that the forces applied to the pivot pin 54 as a result of the fulcrum action described with respect to FIG. 1 are transferred through the bracket 36 to the top rail 32, rather than being borne entirely by the side rail 34. Typically, the top rail 32 is better positioned to handle the forces applied to the pivot pin 54 because it is oriented in generally the same plane as the direction in which the reaction forces are applied to the pin 54. It is within the scope of the present invention to connect a portion of the bracket 36 to the side rail 34 so that a portion of the reaction forces on the pin 54 are transferred to the side rail 34. However, it is preferred that all the bracket 36 be connected solely to the top rail 32 so that all the forces applied to the pivot pin 54 are transferred directly to the top rail 32.

Figure 5:
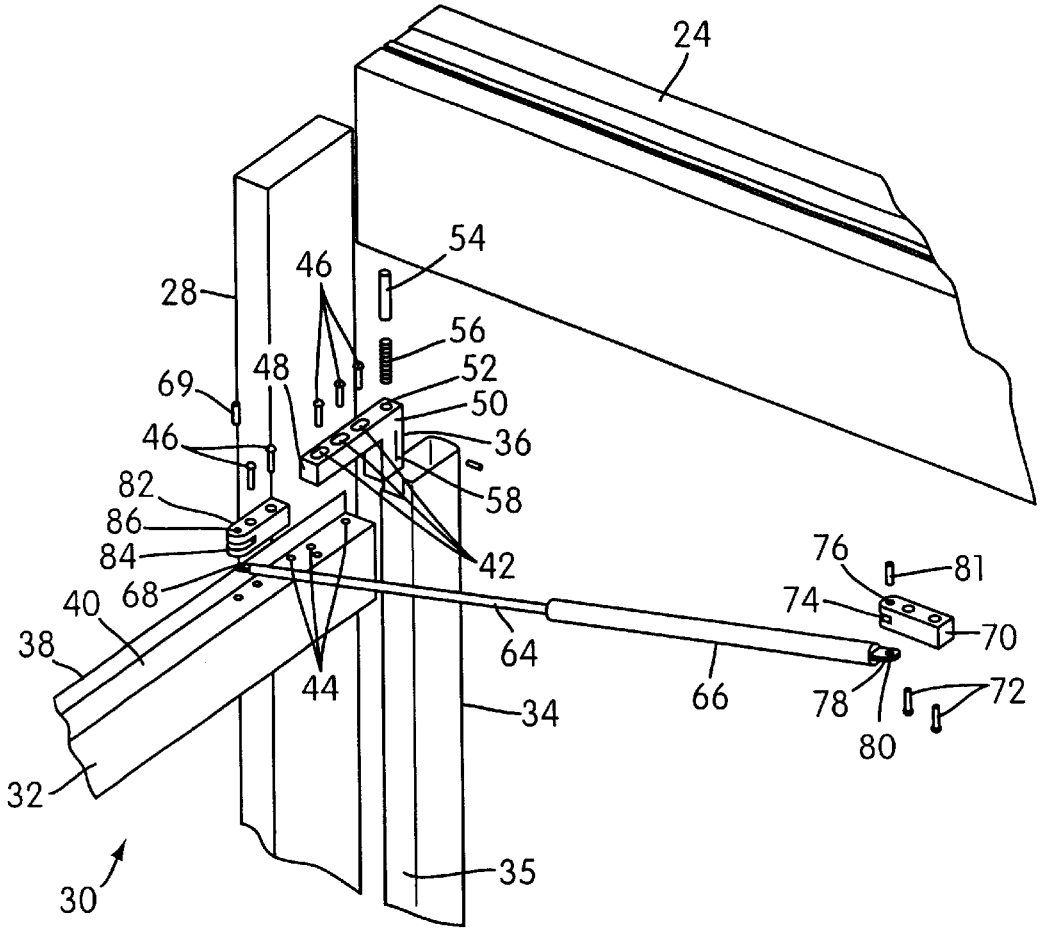
FIG. 5 shows a perspective view similar to FIG. 4 with an alternative construction for a bracket that pivotally connects the breakout panel to the header.

FIG. 5 shows an arrangement similar to that of FIG. 4 with a few notable exceptions. In the arrangement of FIG. 5, the first leg 48 of the bracket 36 is shorter than in FIG. 4 and does not provide a connecting point for the free end of rod 64. Instead, a bracket 82 is secured to the top rail 32 at a position spaced from the end of the first leg 48. The bracket 82 has a pair of spaced apart tabs 84 with openings 86 formed therethrough. As with the bracket 36 of FIG. 4, the free end of the rod 64 is pivotally connected to bracket 82 by inserting the rod free end between tabs 84 and then inserting a pivot pin 69 though openings 64, 86.

Figure 6:
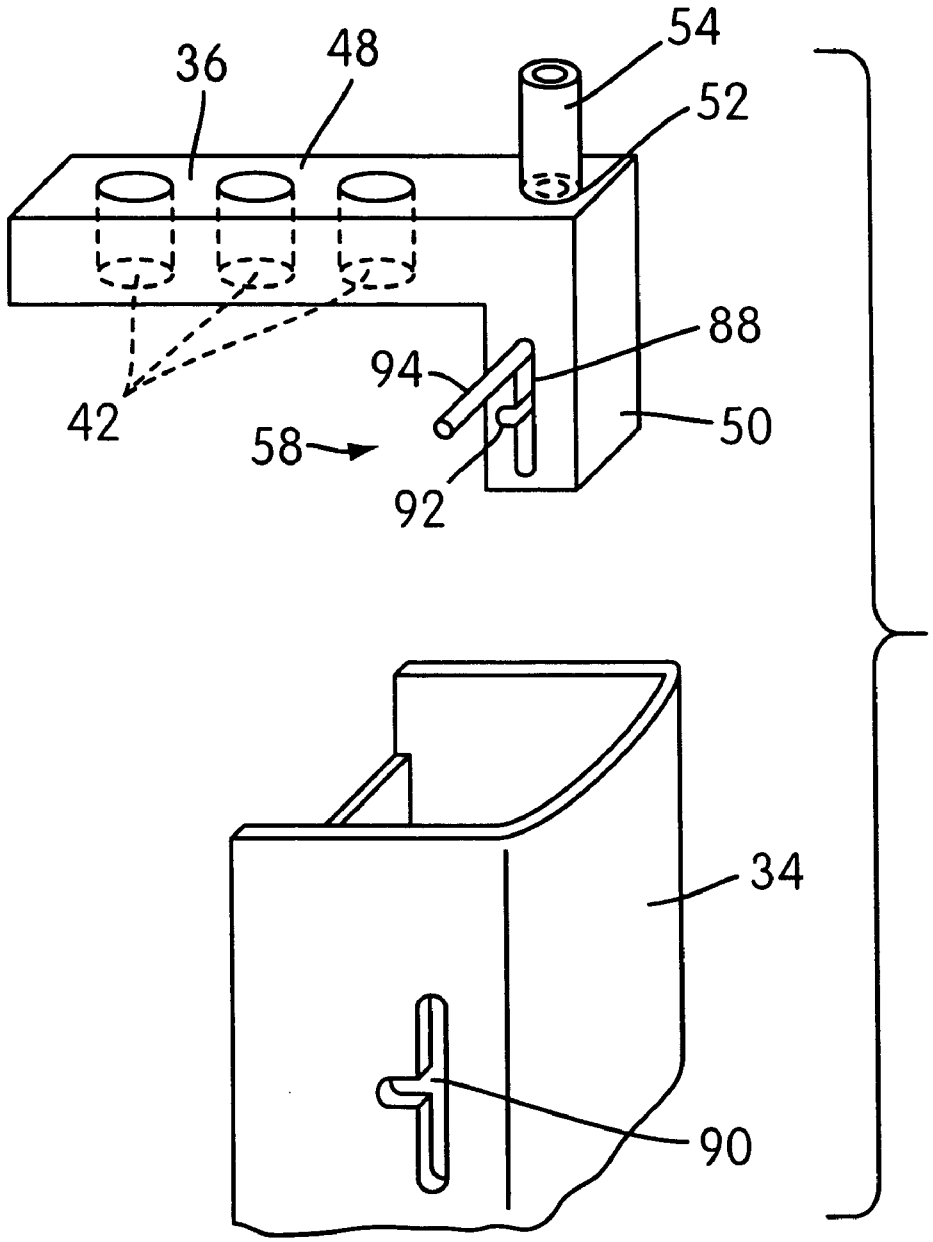
FIG. 6 is an exploded perspective view of the bracket assembly of FIG. 4 that pivotally connects the breakout panel to the header.

FIG. 6 shows the side rail 34 and the bracket 36 in closer detail. The pivot pin 54 has a radial bore (not shown) formed in the lower end thereof and the second leg 50 of the bracket 36 has a generally vertically extending elongated slot 88 formed through the side wall thereof. The side rail 34 also has an elongated slot 90 formed in the side wall thereof. The slot 88 on the second leg 50 has a laterally extending detent 92 at its center. The pin 54 is mounted by first inserting the spring 56 into opening 52 and then inserting the pin 54 into the opening 52 on top of the spring 56. Then, the second leg 50 is inserted into the open end of the side rail 34. Next, an elongated manually engageable release member in the form of a rod 94 is inserted through slot 90, slot 88, and into the radial bore formed in the lower end of the pin 54. The inserted end of the rod 94 and the interior of the radial bore may be threaded to prevent easy withdrawal of the rod 94.

When the rod 94 is moved to the top of the slot 88, as shown in FIG. 6, the pin 54 is disposed in its extended, operative position. To move the pin 54 to its retracted, inoperative position, the rod 94 is manually engaged and moved downwardly within slot 88. This movement occurs against the bias of spring 56. To releasably lock the pin 54 in its inoperative, retracted position, the rod 94 can be manually moved laterally into detent 92. To release the pin 54, the rod 94 is manually manipulated out of the detent 92 and the spring 56 will thereafter bias the pin 54 to its extended, operative position. Together, the rod 94, the slot 88, and the detent 92 provide the releasable locking mechanism 58.

Figure 7:
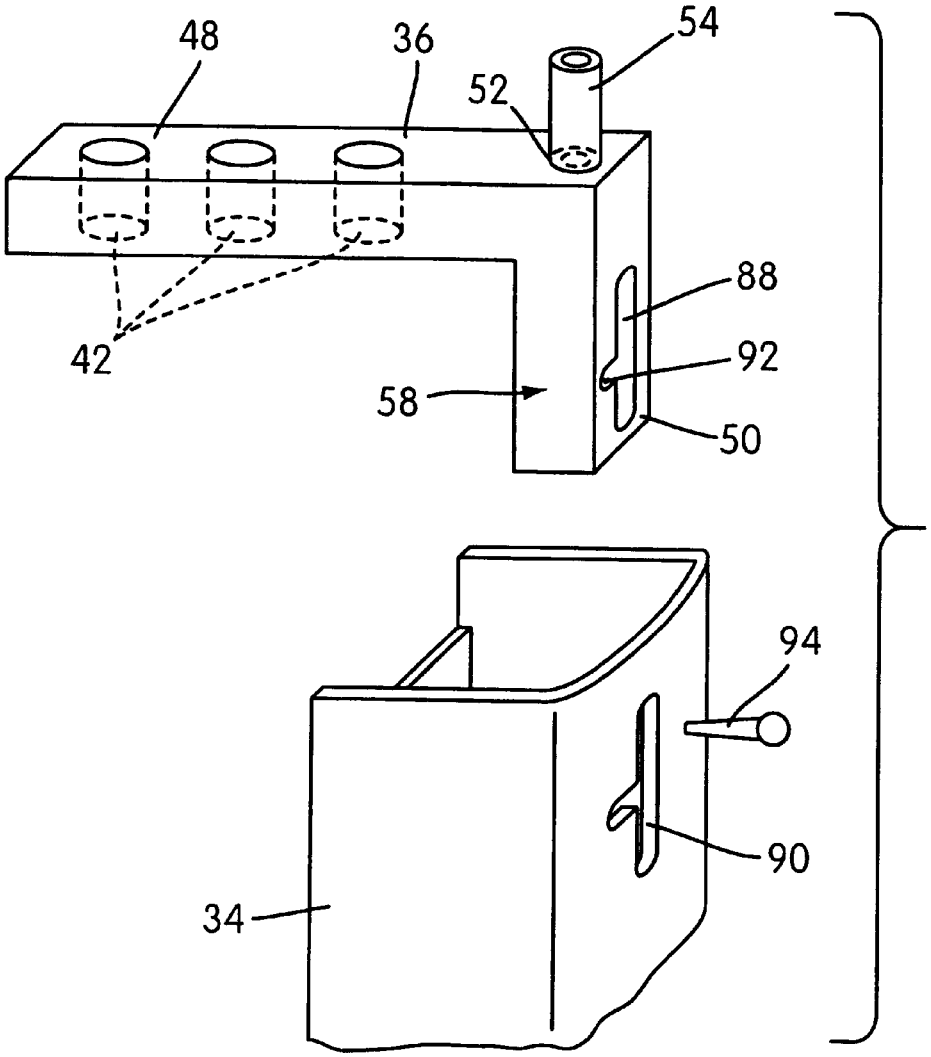
FIG. 7 is a view similar to FIG. 6 showing a first alternative arrangement for the bracket assembly.

FIG. 7 shows an alternative arrangement for the releaseable locking mechanism 58. The arrangement is the same as in FIG. 6 except that the slots 88, 90 are formed in different side walls of the seemed leg 50 and the side rail 34.

Figure 8:
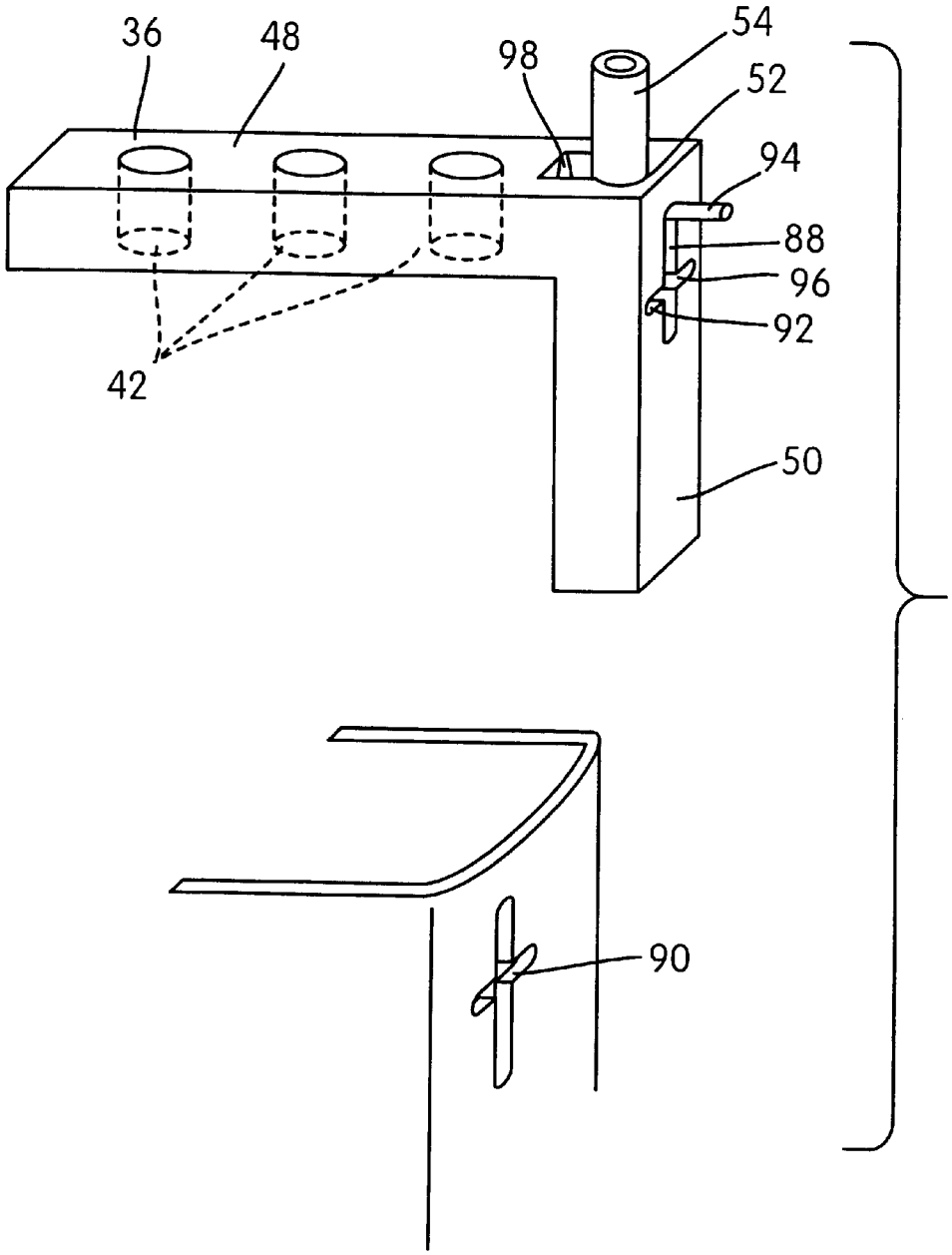
FIG. 8 is a view similar to FIG. 6 showing a second alternative arrangement for the bracket assembly.

FIG. 8 shows another alternative arrangement for the releasable locking mechanism 58. The arrangement is basically the same as in FIG. 7, except that a second detent 96 is provided directly opposite the first detent 92 so that the rod 94 can be moved in either lateral direction during locking/releasing. Also, the opening 52 is keyhole shaped with a protruding portion 98 that provides access to the interior of the opening 52 while the pin 54 and spring 56 are mounted therein. A notch may be formed on the pin 54 so that a slothead screwdriver or a similar implement can be inserted into the portion 98 and engaged with the notch so as to move the pin 54 into its inoperative, retracted position. This is useful in the event the pin 94 is damaged or removed and cannot be used to retract the pin 54.

Figure 9:
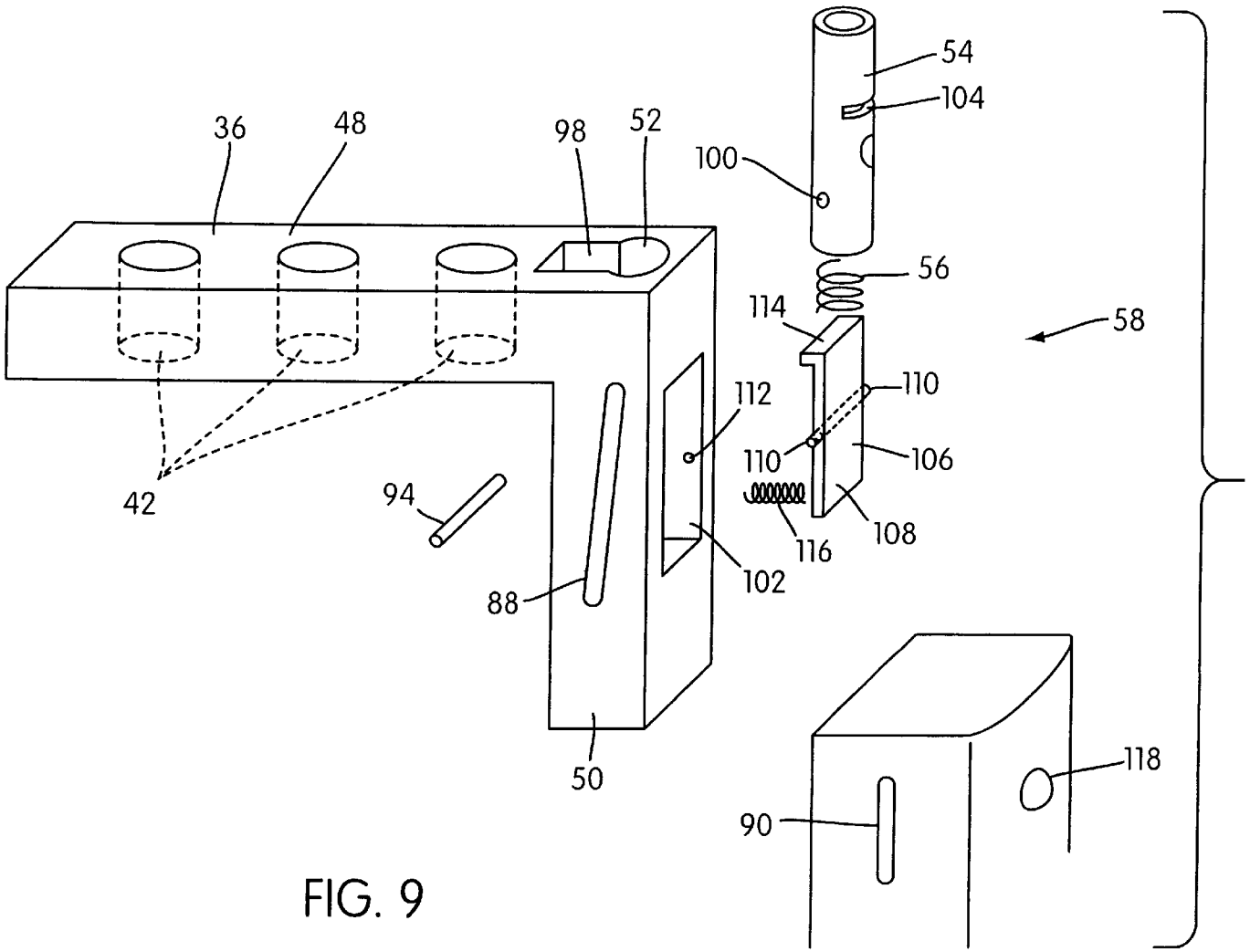
FIG. 9 is a view similar to FIG. 6 showing a third alternative arrangement for the bracket assembly.

FIG. 9 shows yet another alternative embodiment for the releasable locking mechanism 58. As with the previous arrangements, the second leg 50 has a slot 88 and the lower end of pin 54 has a radial bore 100. The spring 56 and pin 54 inserted in the opening 52. The opening 52 is accessible to the exterior of the side wall adjacent the side wall with slot 88 via a rectangular opening 102.

In the embodiment of FIG. 9, the pin 54 is moved downwardly from its operative, extended position to its retracted, inoperative position in the same manner as the previous embodiments by pulling the rod 94 inserted into the radial bore 100 downwardly. However, no detents are provided on slot 88. Instead, a notch 104 is formed on the pin 54 and a release lever 106 engages the notch 104 to retain the pin 54 in its retracted position. The release lever 106 has a rectangular manually engageable portion 108 with a pair of resilient pivot pins 110 extending laterally therefrom. The pins 110 snap into small bores 112 formed an opposing sides of the opening 102 so that the lever 106 can pivot about the pins 110. The lever 106 has a engaging projection 114 at the top edge thereof and a spring 116 is engaged with a lower portion of the lever 106 at a point below the pivot pins 110. The spring 116 is engaged with a fixed spring bearing surface inside the second leg 50 and biases the lever 106 about the pins 110 so as to urge the projection 114 into engagement with the pin 54. When the pin 54 is moved into its retracted, inoperative position, the projection 114 engages the notch 104 so as to releaseably retain the pin 54 thereat. To release the pin 54, the manually engageable portion 108 is pushed in at the lower end thereof against the bias of spring 116 to disengage projection 114 from notch 104. Then, the spring 56 will extend to move the pin 54 into its extended, operative position. An access opening 118 is provided on side rail 34 to provide access to the lower end of the manually engageable portion 108. In this embodiment, lever 106 may be considered the release member because it functions to release the pivot pin 54.

It is to be understood that portion 98 of the opening 52 may or may not be provided in this arrangement and likewise the notch on the pin 54 that is accessible therethrough may or may not be provided. It is preferred, however, that these structures be provided as a back-up release to the rod 94.

Figure 10:
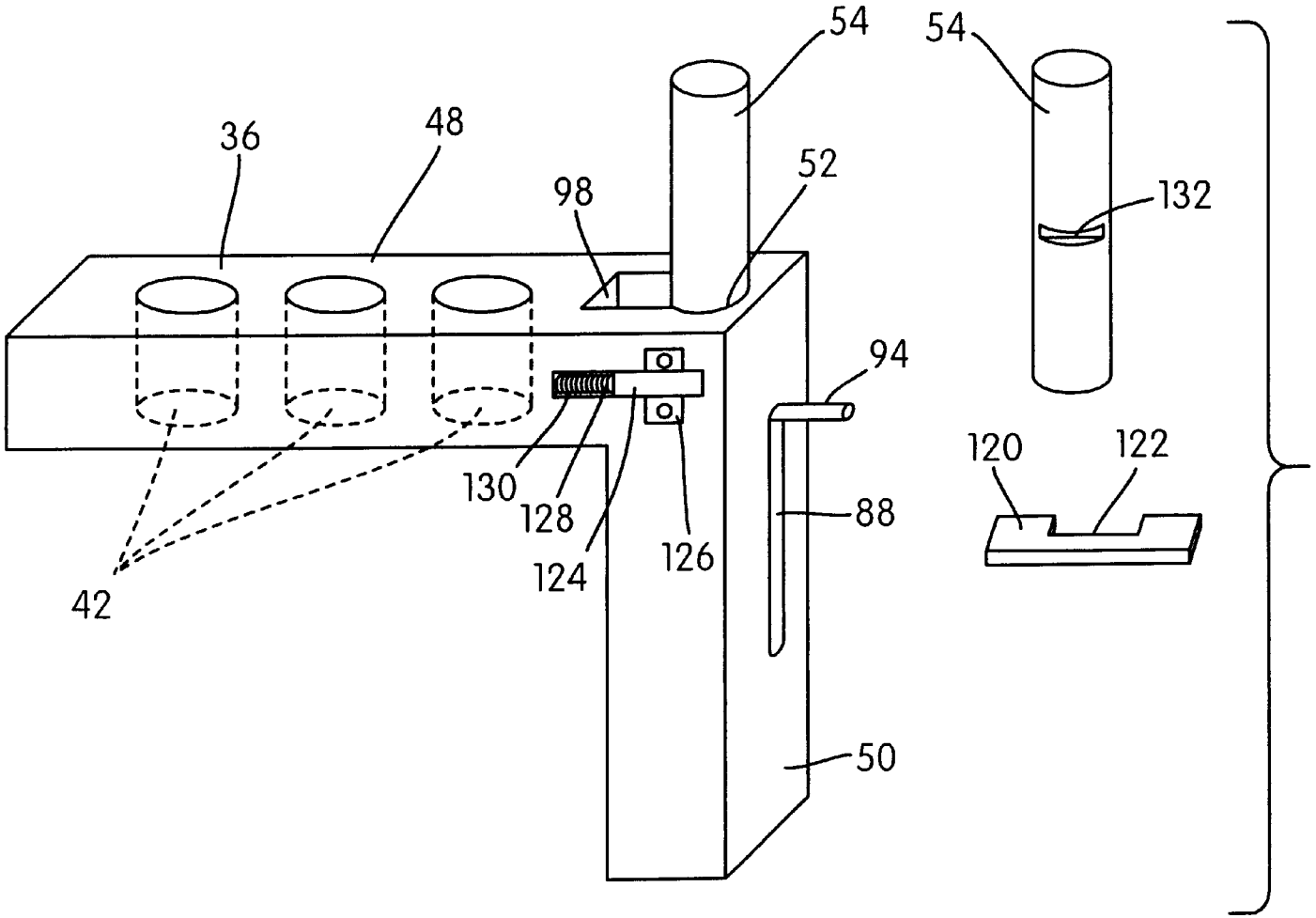
FIG. 10 is a view similar to FIG. 6 showing a fourth alternative arrangement for the bracket assembly.

FIG. 10 shows another alternative arrangement for the releasable locking mechanism 158. In this arrangement, a slidable latching member 120 with a notch 122 formed in the center thereof is provided. An elongated slot 124 is formed through the bracket wall in the direction of the first leg's longitudinal extent. A small bracket 126 supports the member 120 and guides it for rectilinear movements. A manually engageable button 128 is connected to the member 120 through the slot 124 to enable the member 120 to be moved manually in a releasing direction. A spring 130 is engaged between the latching member 120 and a fixed spring bearing surface side the first leg 48. The pin 54 has a notch 132 formed thereon.

When the pin 54 is in its extended, operative position, the pin 54 is received within the notch 122 on the member 120 and prevents the spring 130 from moving the latching member 120. As the pin 54 is moved into its retracted, inoperative position, the notch 132 on the pin 54 aligns with the latching member 120 and the spring 130 then releases and move the latching member 120 into the notch 132 so as to retain the pin 54 thereat. To release the latching member 120, the manually engageable button 128 is slidably moved so that the notch 122 is aligned with notch 132 to allow the pin 54 to extend.

Optionally, the opening 52 may be keyhole shaped with portion 98 provided along with the notch on the pin 54 as described with respect to previous embodiments. This arrangement may be used in place of or in conjunction with pin 94.

It can thus be seen that the objectives of the present invention have been fully and effectively accomplished. It should be realized, however, that the foregoing preferred specific embodiment has been shown and described for the purpose of illustrating the structural and functional principles of the present invention and is subject to change without departure from such principles. Therefore, this invention includes all modifications, alterations, and substitutions encompassed within the spirit and scope of the appended claims.

What is claimed is:

1. A sliding door assembly for installation across an opening formed through a wall of a building, said assembly comprising:

a frame assembly constructed and arranged to be mounted with respect to the opening formed through the wall when said door assembly is installed;

a sliding panel including at least a top rail and a tubular trailing edge stile;

a sliding panel carrier comprising a pivot pin receiving opening, said sliding panel being mounted to said sliding panel carrier;

said sliding panel having a mounting bracket mounted directly to the top rail thereof, said bracket comprising a pivot pin positioned in vertical alignment with the tubular trailing edge stile, said bracket including an aperture for enabling a user to move said between an extended position wherein said pin extends upwardly from pivot pin said sliding panel and a retracted position wherein said pin is moved downwardly from said extended position at least partially into said tubular trailing edge stile and out of said pivot pin receiving opening, said sliding panel carrier being mounted to said frame assembly for generally rectilinear movement relative to said frame assembly to enabe movement of said sliding panel between (1) a closed position with respect to a portion of the opening of the wall to prevent persons and objects from travelling through said portion of the opening of the wall when said door assembly is installed, and (2) an open position with respect to said portion of the opening of the wall to permit persons and objects to travel through the portion of the opening of the wall when said door assembly is installed;

said sliding panel being mounted to said sliding panel carrier by inserting said pivot pin into said pivot pin receiving opening such that said sliding panel can swing relative to said frame assembly through a breakout movement under an application of manual force from (1) a normal, non-breakout position wherein when said door assembly is installed said sliding panel can be moved generally rectilinearly between said open and closed positions thereof, to (2) a breakout position wherein said sliding panel is swung away from said non-breakout position to uncover the portion of the opening of the wall that the sliding panel covers when said door assembly is installed and said sliding panel is in the closed position to thereby enable persons and objects to travel therethrough;

said bracket, said pivot pin, and said pivot pin receiving opening being constructed and arranged such that, when the door assembly is installed and said sliding panel is moved to the breakout position thereof, a load applied to said sliding panel which tends to pivot said sliding panel about a point located distally from said pivot pin creates a reaction force that is transmitted directly to the top rail of said sliding panel and applied to said pivot pin as a result of said mounting bracket being mounted directly to said top rail and said pivot pin being received in said pivot pin receiving opening; and a power-operated door controlling unit constructed and arranged to be operatively connected to said sliding panel carrier, said door controlling unit being constructed and arranged to move said carrier and said sliding panel relative to said frame assembly in a generally rectilinear manner between the open and closed positions thereof when said door assembly is installed.

2. A sliding door assembly according to claim 1, further comprising:

an extendible and retractable door swing controlling device constructed and arranged to be operatively connected at a first end thereof to the top rail of said sliding panel and at a second end thereof to said sliding panel carrier when said door assembly is installed, said door swing controlling device being constructed and arranged to provide controlled resistance to the swinging movement of said sliding panel from said normal, non-breakout position thereof to said breakout position thereof when said door assembly is installed;

wherein said first end of said controlling device comprises said point located distally from said pivot pin.

3. A sliding door assembly according to claim 2, wherein said door swing controlling device comprises:

a piston mounted for reciprocating extending and retracting movements within a fluid-filled cylinder, one of said piston and cylinder comprising said first end of said controlling device and the other of said piston and said cylinder comprising said second end of said controlling device;

said piston and said cylinder being constructed and arranged such that, when said door assembly is installed, moving said sliding panel from said non-breakout position thereof to said breakout position thereof causes said piston to move relative to said cylinder in such a manner that the fluid in said cylinder offers resistance to relative movement of said piston with respect to said cylinder to thereby provide resistance to the swinging movement of sliding panel.

4. A sliding door assembly for installation across an opening formed through a wall of a building, said assembly comprising:

a frame assembly constructed and arranged to be mounted with respect to the opening formed through the wall when said door assembly is installed, said frame assembly comprising a fixed pivot pin receiving opening;

a sliding panel carrier;

a sliding panel mounted to said sliding panel carrier;

said sliding panel carrier being mounted to said frame assembly for generally rectilinear movement relative to said frame assembly to enable movement of said sliding panel between (1) a closed position with respect to a first portion of the opening of the wall to prevent persons and objects from travelling through said first portion of the opening of the wall when said door assembly is installed, and (2) an open position with respect to said first portion of the opening of the wall to permit persons and objects to travel through the first portion opening of the wall when said door assembly is installed;

a power-operated door controlling unit constructed and arranged to be operatively connected to said sliding panel carrier, said door controlling unit being constructed and arranged to move said carrier and said sliding panel relative to said frame assembly in a generally rectilinear manner between the open and closed positions thereof when said door assembly is installed;

a non-sliding panel including at least a top rail and a tubular trailing edge stile;

said non-sliding panel having a mounting bracket mounted directly to the top rail thereof, said bracket comprising a pivot pin positioned in vertical alignmnent with the tubular trailing edge stile, said bracket including an aperture for enabling a user to move said pivot pin between an extended position wherein said pin extends upwardly from said non-sliding panel and a retracted position wherein said pin is moved downwardly from said extended position at least partially into said tubular trailing edge stile and out of said pivot pin receiving opening;

said non-sliding panel being mounted to said frame assembly by inserting said pivot pin into said fixed pivot pin receiving opening such that said non-sliding panel can swing relative to said frame assembly through a breakout movement under an application of manual force from (1) a normal, non-breakout position wherein when said door assembly is installed said non-sliding panel is positioned to close a second portion of the opening of the wall, to (2) a breakout position wherein when said door assembly is installed said non-sliding panel is swung away from said non-breakout position to open the second portion of the opening of the wall that the non-sliding panel normally covers when in the non-breakout position thereof to thereby enable persons and objects to travel therethrough;

said bracket, said pivot pin, and said pivot pin receiving opening being constructed and arranged such that, when the door assembly is installed and said non-sliding panel is moved to the breakout position thereof a load applied to said non-sliding panel at a first point distal from said pivot pin that tends to pivot said non-sliding panel about a second point located intermediate said first point and said pivot pin creates a reaction force that is transmitted directly to the top rail of said non-sliding panel and applied to said pivot pin as a result of said mounting bracket being mounted directly thereon and said pivot pin being received in said pivot pin receiving opening.

5. A sliding door assembly according to claim 4, further comprising:

an extendible and retractable door swing controlling device constructed and arranged to be operatively connected at a first end thereof to the top rail of said non-sliding panel and at a second end thereof to said frame assembly when said door assembly is installed. said door swing controlling device being constructed and arranged to provide controlled resistance to the swinging movement of said non-sliding panel from said normal, non-breakout position thereof to said breakout position thereof;

wherein the first point at which said load is applied to said non-sliding panel is distal from the first end of said door swing controlling device in a direction away from said pivot pin, a connection between said top rail and said first end of said controlling device comprises said second point.

6. A sliding door assembly according to claim 5, wherein said door swing controlling device comprises:

a piston mounted for reciprocating extending and retracting movements within a fluid-filled cylinder, one of said piston and cylinder comprising said first end of said door swing controlling device and the other of said piston and said cylinder comprising said second end of said door swing controlling device, said piston and said cylinder being constructed and arranged such that moving said non-sliding panel from said non-breakout position thereof to said breakout position thereof causes said piston to move relative to said cylinder in such a manner that the fluid in said cylinder offers resistance to relative movement of said piston with respect to said cylinder to thereby provide resistance to the swinging movement of non-sliding panel.

* * * * *